US006920853B2

(12) United States Patent
Nakajima et al.

(10) Patent No.: US 6,920,853 B2
(45) Date of Patent: Jul. 26, 2005

(54) VARIABLE VALVE TIMING CONTROL DEVICE

(75) Inventors: Shigeru Nakajima, Anjo (JP); Taiyu Iwata, Okazaki (JP); Ichiro Hiratsuka, Kariya (JP); Takayuki Kurumi, Chiryu (JP); Kazumi Ogawa, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 48 days.

(21) Appl. No.: 10/382,880

(22) Filed: Mar. 7, 2003

(65) Prior Publication Data

US 2003/0221646 A1 Dec. 4, 2003

(30) Foreign Application Priority Data

Mar. 8, 2002 (JP) ..... 2002-063402
Feb. 27, 2003 (JP) ..... 2003-051581

(51) Int. Cl.[7] ..... F01L 1/34

(52) U.S. Cl. ..... 123/90.17; 123/90.18; 123/90.16; 123/90.15; 123/90.31; 418/46; 418/111; 418/178; 418/235; 464/2; 464/160; 92/122; 92/125

(58) Field of Search ..... 123/90.15–90.18, 123/90.27, 90.31; 464/1, 2, 160; 92/120–126; 418/46, 78–82, 111, 178, 179, 206.9, 235; 428/908.8; 148/206, 207, 210, 212, 218, 239; 427/523, 528, 531, 905

(56) References Cited

U.S. PATENT DOCUMENTS 5,937,810 A * 8/1999 Sato et al. ..... 123/90.17
5,947,067 A * 9/1999 Kawaharaguchi et al. ..... 123/90.17
6,413,061 B1 * 7/2002 Esumi et al. ..... 418/63

FOREIGN PATENT DOCUMENTS

JP 1-092504 A 4/1989
JP 1999-81928 A 3/1999
JP 11182475 A * 7/1999 ..... F04C/18/356

* cited by examiner

*Primary Examiner*—Thomas Denion
*Assistant Examiner*—Kyle M. Riddle
(74) *Attorney, Agent, or Firm*—Burns, Doane, Swecker & Mathis, L.L.P.

(57) ABSTRACT

A variable valve timing control device includes a rotation member for opening or closing a valve, a rotation transmission member engaged with the rotation member to be relatively rotatable, a vane provided on either one of the rotation member or the rotation transmission member, a hydraulic chamber formed between the rotation member and the rotation transmission member and including an advance angle chamber and a retarded angle chamber, the advance angle chamber and the retarded angle chamber being formed by dividing the hydraulic chamber by the vane, a first hydraulic passage for supplying and discharging a fluid to the advance angle chamber, and a second hydraulic passage for supplying and discharging the fluid to the retarded angle chamber. The vane includes a surface hardness determined to be higher than a surface hardness of a sliding surface of the rotation member or the rotation transmission member for sliding the vane.

18 Claims, 5 Drawing Sheets

Fig. 4

Durability Evaluation Result (same conditions)

| | Housing : Aluminum member<br>Vane : Aluminum member | Housing : Aluminum member<br>Vane : Stainless steel<br>+<br>Treated with nitrocarburizing |
|---|---|---|
| Vane side | 1310 μm | 1 μm |
| Housing side | 45 μm | 3 μm |

VARIABLE VALVE TIMING CONTROL DEVICE

This application is based on and claims priority under 35 U.S.C. § 119 with respect to Japanese Patent Application No. 2002-063402 filed on Mar. 8, 2002 and Japanese Patent Application No. 2003-051581 filed on Feb. 27, 2003, the entire content of which is incorporated herein by reference.

FIELD OF THE INVENTION

The present invention relates to a variable valve timing control device. More particularly, the present invention pertains to a variable valve timing control device for controlling a valve timing of an intake and exhaust valves of an internal combustion engine.

BACKGROUND OF THE INVENTION

A known variable valve timing control device is disclosed in Japanese Patent Laid-Open Publication No. H11(1999)-81928. The known variable valve timing control device is provided on a drive force transmission system for transmitting a drive force from a driving shaft of the internal combustion engine to a driven shaft for opening and closing at least one of an intake valve or an exhaust valve of an internal combustion engine. The known variable valve timing control device includes a housing, a vane rotor having vanes rotating relative to the housing within a predetermined angle range, and sealing members supported by the vane rotor to contact the housing for sealing the housing and the vane rotor. With the known variable valve timing control device disclosed in Japanese Patent Laid-Open Publication No. H11(1999)-81928, aluminum or an iron system metal is applied as the housing and the sealing member made of resin with lower hardness than the housing is applied to each tip end of the vane. Because the sealing members always slidingly contact to an internal surface of the housing, the sealing members with low hardness likely to be worn. In case the housing and the vane are applied with the same material such as aluminum, the abrasion may be increased. In this case, for example as shown in FIG. 2, when hard foreign materials (e.g., molding sand) included in engine oil are jammed between the vane and the housing during the sliding operation of the vane, the foreign materials are buried in sliding surfaces on the housing side and on the vane side. Thus, the buried foreign materials on the hosing side and on the vane side scrape the opposing sliding surfaces on the housing side and the vane side one another to accelerate the abrasion as aggressive abrasion. Thus, the performance of the variable valve timing control device may be deteriorated. And foreign materials generated by the sliding abrasion influence causing defects such as burning of a camshaft and an operation lock of an OCV (i.e., oil pressure control valve).

On the other hand, another known variable valve timing control device is disclosed in Japanese Patent Laid-Open Publication No. H01(1989)-092504. The known variable valve timing control device disclosed in Japanese Patent Laid-Open Publication No. H01(1989)-092504 includes a rotor for opening and closing a valve, a housing engaged with the rotor to be relatively rotatable, a vane provided to be slidably fitted in a vane groove formed on the rotor, a hydraulic chamber formed between the rotor and the housing and divided into an advance angle chamber and a retarded angle chamber by the vane, a first hydraulic passage for supplying or discharging the fluid to or from the advance angle chamber, and a second hydraulic passage for supplying or discharging the fluid to or from the retarded angle chamber. The vane fitted in the vane groove of the rotor is biased towards the housing side by a vane spring so that the rotor and the vane are unitary rotated. With the known variable valve timing control device, the vane groove on the rotor and the vane are repeatedly pushed against one another by the operation chamber hydraulic pressure. In addition, when the vane slides on an internal periphery of the housing in an peripheral direction, the vane slides in a radial direction due to a variation of a clearance between the rotor and the housing and the circularity error of the internal peripheral surface of the housing. When small and hard foreign materials (e.g., molding sand, sand invaded from outside) or carbon soot are invaded from the hydraulic pressure chamber of the variable valve timing control device, the sliding portion is abraded. Particularly, because the molding sand is harder than other foreign materials and has larger particle diameter compared to other foreign materials, the aggressive abrasion at the sliding portions may be caused. Further, in case the vane and the sliding surface of the sliding portion of the vane are ruined, the aggressive abrasion may advance quickly. Due to the influence of the foreign materials generated by the performance deterioration and the sliding abrasion of the variable valve timing control device, drawbacks such as burning of a camshaft and the operation lock of the oil pressure control valve (OCV) may be caused.

A need thus exists for a variable valve timing control device which includes high abrasion resistance between a housing and a vane and between a rotor and the vane for preventing a performance deterioration and defects.

SUMMARY OF THE INVENTION

In light of the foregoing, the present invention provides a variable valve timing control device for controlling a valve timing of an intake valve or an exhaust valve of an internal combustion engine which includes a rotation member for opening or closing a valve, a rotation transmission member engaged with the rotation member to be relatively rotatable, a vane provided on either one of the rotation member or the rotation transmission member, a hydraulic chamber formed between the rotation member and the rotation transmission member and including an advance angle chamber and a retarded angle chamber, the advance angle chamber and the retarded angle chamber being formed by dividing the hydraulic chamber by the vane, a first hydraulic passage for supplying and discharging a fluid to the advance angle chamber, and a second hydraulic passage for supplying and discharging the fluid to the retarded angle chamber. The vane includes a surface hardness determined to be higher than a surface hardness of a sliding surface of the rotation member or the rotation transmission member for sliding the vane.

According to another aspect of the present invention, a variable valve timing control device for controlling a valve timing of an intake valve or an exhaust valve of an internal combustion engine includes a rotor for opening or closing a valve, a housing engaged with the rotor to be relatively rotatable, a vane provided on either one of the rotor or the housing, a hydraulic chamber formed between the rotor and the housing and including an advance angle chamber and a retarded angle chamber, the advance angle chamber and the retarded angle chamber being formed by dividing the hydraulic chamber by the vane, a first hydraulic passage for supplying and discharging a fluid to the advance angle chamber, and a second hydraulic passage for supplying and discharging the fluid to the retarded angle chamber. The vane includes a surface hardness determined to be higher than a surface hardness of a sliding surface of the rotor or the housing for sliding the vane.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

FIG. 4 is a view showing a durability evaluation result of the sliding portion between the housing and the sealing member according to the embodiment of the present invention and the known variable valve timing device.

DETAILED DESCRIPTION OF THE INVENTION

Figure 1:
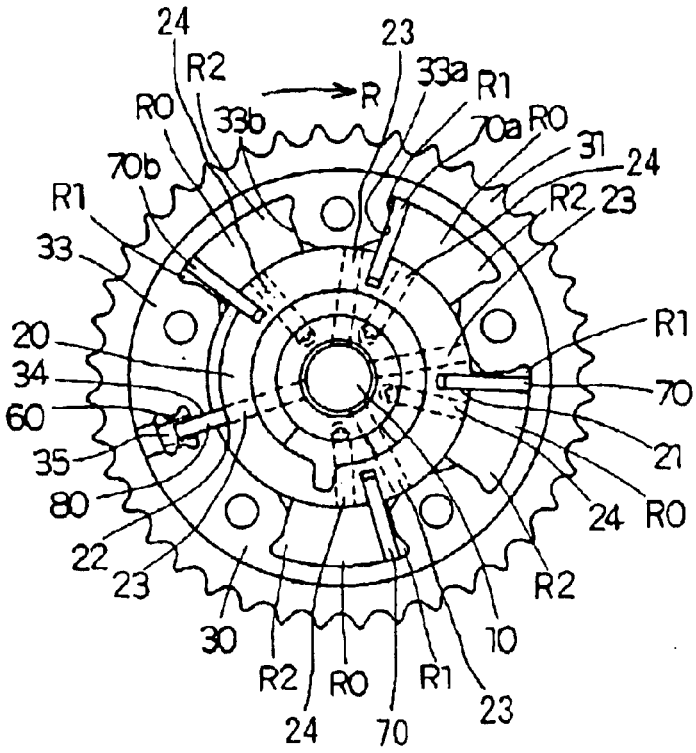
FIG. 1 shows a lateral cross-sectional view of a variable valve timing control device according to an embodiment of the present invention.
Figure 2:
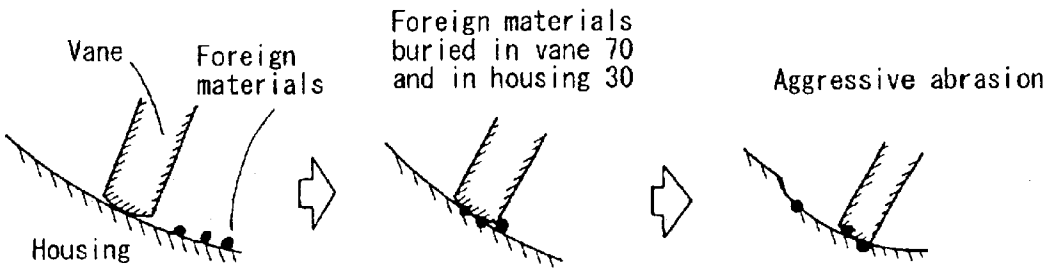
FIG. 2 shows a view showing sliding portions between a housing and a vane according to a known variable valve timing control device.
Figure 3:
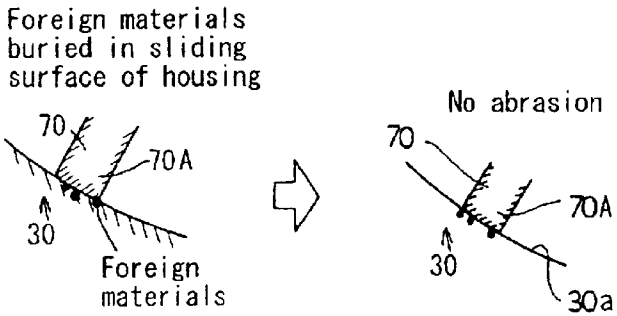
FIG. 3 is a view showing a sliding portion between a housing and a vane according to the embodiment of the present invention.

One embodiment of a variable valve timing control device will be explained with reference to the illustrations in the drawing figures.

Referring to the illustration in FIG. 1, the variable valve timing control device includes a rotor (i.e., serving as a rotation member) 20 unitary assembled to a tip end portion of a camshaft 10 rotatably supported by a cylinder head (not shown) of an internal combustion engine, a housing (i.e., serving as a rotation transmission member) 30 integrally provided with a timing sprocket 31 on an external periphery thereof, and four vanes 70, 70, 70*a*, 70*b*, assembled to the rotor 20. The timing sprocket 31 is transmitted with the rotational force in the clockwise direction R from a crankshaft (not shown) via a crank sprocket and a timing chain.

Figure 5:
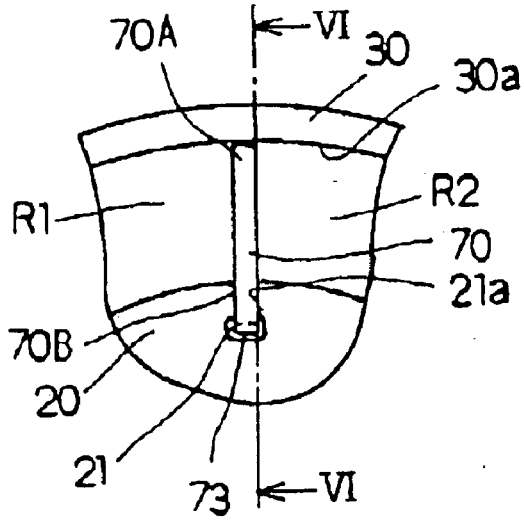
FIG. 5 is a view showing an assembling state of the vane according to the embodiment of the present invention.
Figure 6:
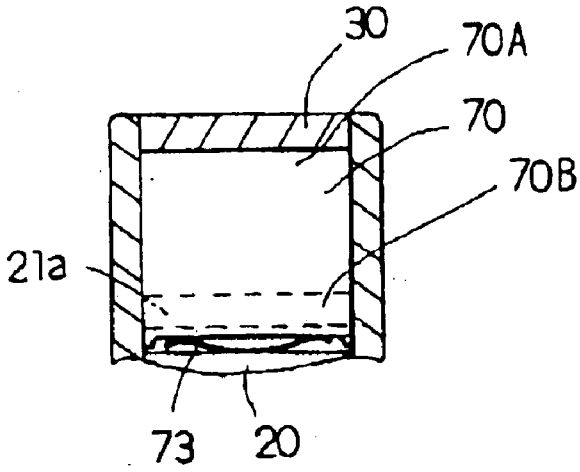
FIG. 6 is a cross sectional view taken on line VI—VI of FIG. 5.

The rotor 20 is unitary secured to the camshaft 10 with an assembling bolt (not shown). The rotor 20 includes four vane grooves 21, a receiving groove 22, four advance angle passages (i.e., serving as a first hydraulic passage) 23 extended in a radial direction and four retarded angle passages (i.e., serving as a second hydraulic passage) 24 extended in a radial direction. Four vanes 70, 70, 70*a*, 70*b* are provided in respective vane grooves 21 to be movable in the radial direction. A leaf spring 73 (shown in FIGS. 5–6) is provided between a bottom portion of the vane groove 21 and a bottom surface of the vane 70. Thus, as shown in FIGS. 5–6, the vane 70 is always biased outwardly by the leaf spring 73 while sliding on a sliding surface of the housing 30. The receiving groove 22 is provided with a lock key 80 whose head portion enters the receiving groove 22 by a predetermined amount when relative positions between the camshaft 10 and the rotor 20 and the housing 30 are synchronized at a predetermined phase (i.e., a most retarded angle position). The receiving groove 22 is in communication with one of the advance angle passages 23.

The housing 30 is rotatably assembled relative to an external periphery of the rotor 20 within a predetermined angle range. The timing sprocket 31 is integrally formed on the external periphery of the housing 30.

Four convex portions 33 are formed on an internal periphery of the housing 30 in a peripheral direction. Internal peripheral surfaces of the convex portions 33 contact an external peripheral surface of the rotor 20 to rotatably support the housing 30 by the rotor 20. One of the convex portions 33 is formed with a retraction groove 34 for accommodating the lock key 80 and an accommodation groove 35 of a spring 60 for biasing the lock key 80 in the radially internal direction.

Each vane 70 divides a hydraulic chamber R0 formed between the housing 30 and the rotor 20 and between two convex portions 33 adjacent to each other in the peripheral direction into an advance angle hydraulic chamber (i.e., serving as an advance angle chamber) R1 and a retarded angle hydraulic chamber (i.e., serving as a retarded angle chamber) R2. The relative rotation amount between the housing 30 and the rotor 20 is defined depending on a peripheral width (i.e., angle) of the hydraulic chamber R0. The relative rotation at a most advance angle side is restricted at a position where the vane 70*a* contacts a first side surface 33*a* of the convex portion 33. The relative rotation between the rotor 20 and the housing 30 at a most retarded angle side is restricted at a position where the vane 70*b* contacts a second side surface 33*b* of the convex portion 33. The relative rotation between the rotor 20 and the housing 30 is restricted by the insertion of the head portion of the lock key 80 into the receiving groove 22 at the most retarded angle side.

The operation of the variable valve timing control device with the foregoing configuration according to the embodiment of the present invention will be explained as follows.

The variable valve timing control device obtains desired valve timing by controlling the relative rotation of the rotor 20 relative to the housing 30 by adjusting the hydraulic pressure in each advance angle hydraulic chamber R1 and each retarded and hydraulic chamber R2. Under the condition that the internal combustion engine is stopped, the head portion of the lock key 80 is fitted in the receiving groove 22 of the rotor 20 by the predetermined amount to lock the relative rotation between the rotor 20 and the housing 30 at the most retarded angle position.

When the advance angle is required for the valve timing in accordance with the driving condition after the start of the internal combustion engine, the operation fluid (i.e., hydraulic pressure) supplied from an oil pump (not shown) is supplied to the advance angle hydraulic chamber R1 via the passages 23 by the operation of switching valve (not shown). The operation fluid is supplied to the receiving groove 22 via the passage 23. On the other hand, the operation fluid (i.e., hydraulic pressure) in the retarded angle hydraulic chamber R2 is discharged to an oil pan (not shown) from the switching valve via the passages 24. Under this operation, the lock key 80 moves against the biasing force of the spring 60. The head portion of the lock key 80 is removed from the receiving groove 22 to release the lock between the rotor 20 and the housing 30. Accordingly, the rotor 20 unitary rotating with the camshaft 10 and vanes 70 are rotated to the advance angle side (i.e., in the clockwise direction) R relative to the housing 30.

When the retarded angle is required for the valve timing in accordance with the driving condition, the operation fluid (i.e., hydraulic pressure) supplied from the oil pump is supplied to the retarded angle chamber R2 via the passage 24 by the operation of the switching valve. On the other hand, the operation fluid in the advance angle chamber R1 is discharged to the oil pan from the switching valve via the passage 23. Accordingly, the rotor 20 and vanes 70 are rotated to the retarded angle side (i.e., in the counter-clockwise direction) relative to the housing 30.

The detailed explanation of the present invention will be provided referring to FIGS. 3–7 as follows. When either one of the advance angle or the retarded angle are required in accordance with the foregoing operation conditions and the rotor 20 and the vane 70 are rotated relative to the housing 30, as shown in FIG. 5, the vane 70 is outwardly biased by the leaf spring 73 so that a tip end portion 70A of the vane 70 slides on a sliding surface 30*a* of the housing 30. In case the foreign materials (e.g., molding sand) are included in the operation fluid under the foregoing condition, the foreign materials are accumulated on the sliding surface 30*a* of the housing 30 due to the centrifugal force by the rotation of the rotor 20 and the housing 30 and the sliding surface 30*a* of the housing 30 and the tip end portion 70A of the vane 70 slide against each other to abrade the sliding surface 30*a* and the tip end portion 70A. However, because the surface hardness of the vane 70 is determined to be greater than the surface hardness of the sliding surface 30*a* of the housing 30, the foreign materials are buried in the sliding surface 30*a* of the housing 30 before being buried in the tip end portion 70A of the vane 70 (shown in FIG. 3). In addition, because the sliding surface corresponds to a width of the hydraulic chamber R0 (i.e., of the internal surface of the housing 30) in the peripheral direction, the foreign materials buried in the sliding surface of the housing are dispersed in the width of the hydraulic chamber R0 in the peripheral direction. Thus, as shown in FIG. 4, the abrasion of the sliding surface 30*a* of the housing 30 and the tip end portion 70A of the vane 70 are further reduced compared to the case applying the same material such as aluminum to both the housing 30 and the vane 70. In addition, by determining the surface roughness of the vane 70 to be equal to or less than 3.2 z, the aggressiveness relative to the sliding surface 30*a* can be mitigated.

Figure 7:
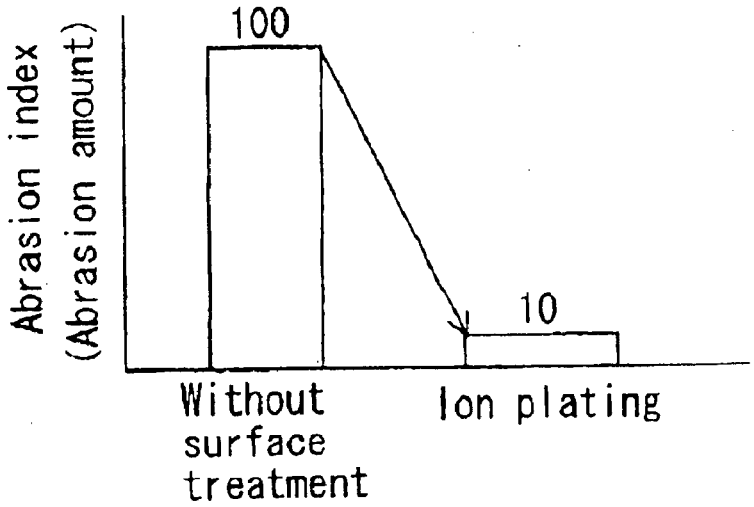
FIG. 7 is a view showing a comparison of an abrasion index (i.e., abrasion amount) of sliding portions of the vane and a rotor between a known device without surface treatment and the embodiment of the present invention.

On the other hand, the vane groove 21 of the rotor 20 and the vane 70 are repeatedly strongly pushed each other by the hydraulic pressure of the advance angle chamber R1 and the retarded angle chamber R2. In addition, when the vane 70 slides on the sliding surface 30*a* of the housing 30 accompanied with a variation of the clearance between the rotor 20 and the housing 30 and the circularity error of the sliding surface 30*a*, the vane 70 slides in the radial direction of the rotor 20. In case the foreign materials included in the operation fluid (e.g., molding sand, sand invaded from outside) or the carbon soot are involved between a fitting portion 21*a* of the vane groove 21 of the rotor 20 and a fitting potion 70B of the vane 70, the abrasion of the fitting portion 70B is generated. However, because the surface hardness of the vane 70 is determined to be greater than the hardness of the molding sand, the molding sand is buried into the fitting portion 21*a* of the vane groove 21 of the rotor 20 made of iron system sintered metal having low hardness so that the abrasion of the fitting portion 70B of the vane 70 is reduced as shown in FIG. 7. Further, by determining the surface roughness of the vane 70 to be equal to or less than 3.2 z, the aggressiveness relative to the fitting portion 21*a* is improved to further reduce the abrasion.

It is preferable that the vane 70 is made of stainless steal or high speed tool steal treated with the ion plating of chrome nitride or treated with nitrocarburizing.

It is preferable to apply the ion plating or the nitrocarburizing treatment only to the sliding portions such as the tip end portion 70A of the vane 70 and the fitting portion 70B to reduce the manufacturing cost.

It is also preferable that the rotor 20 and the housing 30 are made of aluminum, iron system metal or iron system sintered alloy having lower hardness than the surface hardness of the vane 70.

According to the embodiment of the present invention, the surface hardness of the vane is determined to be greater than the surface hardness of the sliding surface of the either one of the rotation member or the rotation transmission member on which the vane slides. Because the foreign materials are buried in the sliding surface of the rotation member or the rotation transmission member and the surface area of the sliding surface in which the foreign materials are buried is large, the abrasion between the sliding surfaces of the housing and the vane can be reduced.

According to the embodiment of the present invention, by forming the vane with the stainless steal treated with nitrocarburizing and forming the rotation member or the rotation transmission member with the aluminum member, the surface hardness of the vane is increased by surface treatment and thus the abrasion between the sliding surfaces of the vane and either one of the rotation member or the rotation transmission member is reduced.

According to the embodiment of the present invention, by determining the surface hardness of the vane slidably fitting into the vane groove formed on the rotation member to be greater than the foreign materials included in the operation fluid, the sliding portion of the vane is protected to reduce the abrasion of the sliding portions of the rotation member and the vane.

According to the embodiment of the present invention, by forming the vane with the metal treated with nitrocarburizing, the surface hardness of the vane can be increased by the surface treatment.

According to the embodiment of the present invention, the vane is made of metal treated with the ion plating. Because the surface treatment temperature is relatively low, the distortion of the vane at the treatment can be prevented to the minimum and thus the precision after the treatment can be ensured.

According to the embodiment of the present invention, the surface roughness of the vane after the nitrocarburizing treatment and the ion plating treatment is determined to be equal to or less than 3.2 z. Thus, the aggressive abrasion relative to the sliding mating members can be improved.

According to the embodiment of the present invention, the nitrocarburizing treatment or the ion plating is applied to at least one of the fitting portion of the vane relative to the vane groove or the tip end portion of the vane. Thus, the manufacturing cost for the surface treatment can be reduced.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing control device for controlling a valve timing of an intake valve or an exhaust valve of an internal combustion engine comprising:

a rotation member for opening or closing a valve;

a rotation transmission member engaged with the rotation member to be relatively rotatable;

a vane provided on either one of the rotation member or the rotation transmission member;

a hydraulic chamber formed between the rotation member and the rotation transmission member and including an advance angle chamber and a retarded angle chamber, the advance angle chamber and the retarded angle chamber being formed by dividing the hydraulic chamber by the vane;

a first hydraulic passage for supplying and discharging a fluid to the advance angle chamber; and a second hydraulic passage for supplying and discharging the fluid to the retarded angle chamber; wherein the vane includes a surface hardness determined to be higher than a surface hardness of a sliding surface of the rotation member or the rotation transmission member for sliding the vane; and at least a tip end portion of the vane possesses a surface hardness higher than the surface hardness of the sliding surface of the rotation member or the rotation transmission member on which the tip end portion of the vane slides.

2. A variable valve timing control device according to claim 1, wherein the vane is made of stainless steel treated with nitrocarburizing and the rotation transmission member are made of aluminum.

3. A variable valve timing control device for controlling a valve timing of an intake valve or an exhaust valve of an internal combustion engine comprising:

a rotor for opening or closing a valve;

a housing engaged with the rotor to be relatively rotatable;

a hydraulic chamber formed between the rotor and the housing and including an advance angle chamber and a retarded angle chamber, the advance angle chamber and the retarded angle chamber being formed by dividing the hydraulic chamber by the vane;

a first hydraulic passage for supplying and discharging a fluid to the advance angle chamber; and a second hydraulic passage for supplying and discharging the fluid to the retarded angle chamber; wherein the vane includes a surface hardness determined to be higher than a surface hardness of a sliding surface of the rotor or the housing for sliding the vane; and at least a tip end portion of the vane possesses a surface hardness higher than the surface hardness of the sliding surface of the rotor or the housing on which the tip end portion of the vane slides.

4. A variable valve timing control device according to claim 3, wherein the vane is made of stainless steel treated with nitrocarburizing and the rotor or the housing are made of aluminum.

5. A variable valve timing control device comprising:

a rotation member for opening or closing a valve;

a rotation transmission member engaged with the rotation member to be relatively rotatable;

a vane provided on either one of the rotation member or the rotation transmission member;

a hydraulic chamber formed between the rotation member and the rotation transmission member and including an advance angle chamber and a retarded angle chamber, the advance angle chamber and the retarded angle chamber being formed by dividing the hydraulic chamber by the vane;

a first hydraulic passage for supplying and discharging a fluid to the advance angle chamber; and a second hydraulic passage for supplying and discharging the fluid to the retarded angle chamber;

a vane groove formed on the rotation member; wherein surface hardness of the vane slidably fitted in the vane groove is determined to be higher than a foreign material included in the fluid.

6. A variable valve timing control device according to claim 5, wherein the surface hardness of the vane is determined to be equal to or higher than Hv 1100.

7. A variable valve timing control device according to claim 6, wherein the vane is made of metal treated with nitrocarburizing.

8. A variable valve timing control device according to claim 5, wherein the vane is made of metal treated with ion plating.

9. A variable valve timing control device according to claim 6, wherein the vane is made of metal treated with ion plating.

10. A variable valve timing control device according to claim 8, wherein the ion plating corresponds to an ion plating of chrome nitride.

11. A variable valve timing control device according to claim 9, wherein the ion plating corresponds to an ion plating of chrome nitride.

12. A variable valve timing control device according to claim 7, wherein the vane includes surface roughness equal to or less than 3.2 z after being treated with the nitrocarburizing.

13. A variable valve timing control device according to claim 8, wherein the vane includes surface roughness equal to or less than 3.2 z after being treated with the ion plating.

14. A variable valve timing control device according to claim 10, wherein the vane includes surface roughness equal to or less than 3.2 z after being treated with the ion plating.

15. A variable valve timing control device according to claim 7, wherein the nitrocarburizing treatment is performed on at least one of a fitting portion between the vane and the vane groove and at a head portion of the vane.

16. A variable valve timing control device according to claim 8, wherein the ion plating is performed on at least one of a fitting portion between the vane and the vane groove and at a head portion of the vane.

17. A variable valve timing control device according to claim 10, wherein the ion plating is performed on at least one of a fitting portion between the vane and the vane groove and at a head portion of the vane.

18. A variable valve timing control device according to claim 12, wherein the nitrocarburizing performed on at least one of a fitting portion between the vane and the vane groove and at a head portion of the vane.

* * * * *